United States Patent [19]

Bollenrath et al.

[11] Patent Number: 4,984,899

[45] Date of Patent: Jan. 15, 1991

[54] AGITATOR VESSEL WITH RADIALLY CONVEYING AGITATOR AND WITH AT LEAST ONE BAFFLE, AS WELL AS PROCESS FOR THE THOROUGH MIXING OF LIQUIDS WITH THE AID OF THIS AGITATOR VESSEL

[75] Inventors: Franz-Michael Bollenrath, Marl; Josef K. Rigler, Dülmen, both of Fed. Rep. of Germany

[73] Assignee: Huls AG, Marl, Fed. Rep. of Germany

[21] Appl. No.: 369,602

[22] Filed: Jun. 21, 1989

[30] Foreign Application Priority Data

Jun. 22, 1988 [DE] Fed. Rep. of Germany ..... 3821033

[51] Int. Cl.[5] ..... B01F 7/04

[52] U.S. Cl. ..... 366/302; 366/314

[58] Field of Search ..... 366/306, 307, 305, 302, 366/303, 309, 314, 304, 205; 422/129

[56] References Cited

U.S. PATENT DOCUMENTS

| | | | |
|---|---|---|---|
| 2,914,385 | 11/1959 | Massey | 366/307 |
| 3,273,865 | 9/1966 | White | 366/307 |
| 3,321,283 | 5/1967 | Ewald | 366/307 |
| 4,497,911 | 2/1985 | Rigler et al. | 521/60 |
| 4,728,731 | 3/1988 | Raehse | 366/307 |

*Primary Examiner*—Robert W. Jenkins

*Attorney, Agent, or Firm*—Antonelli, Terry, Stout & Kraus

[57] ABSTRACT

An agitator vessel is equipped with a radially conveying agitator and with at least one baffle, for the thorough mixing of liquids, the at least one baffle has the shape of an airfoil profile and is arranged below the level of liquids and above the blades of the agitator.

The agitator vessel is equipped with a radially conveying agitator 3 and at least one baffle 2, the latter having the shape of an airfoil profile.

10 Claims, 1 Drawing Sheet

Figure 1:
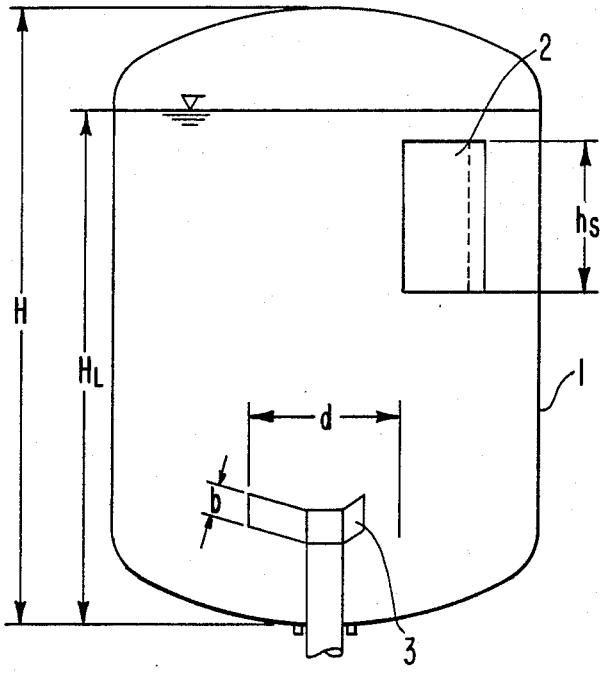

AGITATOR VESSEL WITH RADIALLY CONVEYING AGITATOR AND WITH AT LEAST ONE BAFFLE, AS WELL AS PROCESS FOR THE THOROUGH MIXING OF LIQUIDS WITH THE AID OF THIS AGITATOR VESSEL

This invention relates to an agitator apparatus and process of using this apparatus for thorough mixing of liquids. The homogenous intermixing of liquids in reactors, especially in large-scale reactors, is nowise unproblematic. In such reactors one objective resides not only in obtaining a satisfactory intermixing effect, but also in avoiding any froth formation. The liquid material, for example, a polymerization batch, is not to form any funnel, and, in particular, is not to draw in any gas. Caking is to be avoided since it leads in many cases to product damage and inhomogeneities. As is known, it is especially difficult to attain homogeneous intermixing in case of liquids consisting of two or more liquid components of differing densities.

In all these instances, conventional agitator vessels equipped with a customary agitator lead to unsatisfactory results.

This is so because, when using a customary type of agitator, e.g. a disk agitator (Rushton turbine), a mixing action is achieved which, though satisfactory in the horizontal orientation, is extraordinarily poor in the axial orientation. Eddy formation can be avoided most simply by the additional installation of baffles. In a conventional type of design, an agitator vessel (diameter D) is utilized, and a Rushton turbine, and four baffles having a width of about D/10 are mounted along the agitator vessel wall. A disadvantage resides in that these baffles are not adjustable and therefore cannot be adapted to the respective agitation problems. In most cases, the formation of incrustations cannot be avoided on the baffles, which case a considerably higher power consumption.

Very good mixing results are obtained according to the state of the art by means of the Pfaudler system (compare prospectus of Pfaudler-Werke, D-6830 Schwetzingen, 1978). The agitator employed is usually an impeller agitator according to Pfaudler. Between the agitator diameter d and the height of the agitator blade b there exists the relationship d/10=b. The rotatably mounted baffles, having usually three fingers (*Mixing in the Chemical Industry*, Pergamon Press, I. Sterbacek, Tausk, 1965, p. 281), the ends of which fingers can be joined, are in most cases, located directly above the agitator. While the intermixing in the lower region of the agitator vessel is satisfactory, problems are encountered with respect to axial intermixing especially in case of large-size and slim agitator vessels, unless the agitating power is considerably increased which, in turn, leads to undesirable funnel formation.

U.S. Pat. No. 4,497,911 discloses a process for the production of styrene polymers with the addition of low-boiling blowing agents wherein the objective is to obtain a maximally funnel-free surface during agitation. It is suggested, inter alia, to employ an agitation system consisting of an agitator vessel, an axially arranged agitator, preferably an impeller agitator, and a finger baffle of Pfaudler design arranged in the proximity of the agitator. Such an agitating system is usable, above all, in case the filling level is not higher than the vessel diameter. Problems arise in case of agitator vessels filled to a higher level. It can be seen from the examples that the product quality is considerably impaired if the operation is not performed without eddies.

Therefore, it is an object of the present invention to develop an agitation apparatus exhibiting the following properties:

1. The apparatus should afford rapid axial intermixing of liquids of differing densities.
2. No foam is to evolve during agitation.
3. There should be no formation of a funnel, or the formation of only an insubstantial (i.e. very small) funnel, during agitation.
4. No gas should be drawn from above the liquid level during agitation.
5. The agitating apparatus should work reliably even in case of large liquid levels or filing heights $H_L$ ($H_L/D > 1$) wherein D represents the diameter of the vessel containing the agitator.

Figure 2:
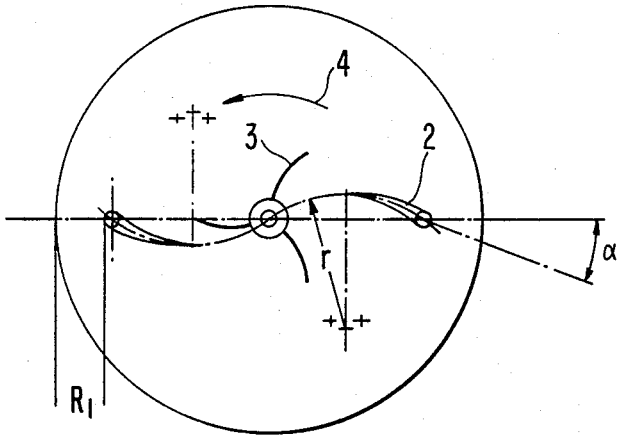

This object and others can be obtained from the device of the present invention which device is further described hereinafter and is illustrated in the accompanying drawings wherein:

FIG. 1 is a schematic side view of the agitator device showing the vertical arrangement of the axial agitator and at least one baffle in the agitator vessel, and FIG. 2 is a plan schematic view of the device showing the shape of the baffles and the positions of the baffle with respect to the axial agitator.

As shown in FIG. 1, the agitator vessel of the invention includes an agitator vessel 1 which is equipped with a radially conveying agitator 3 and with at least one adjustable baffle 2. The vessel is characterized by the following features:

The radially conveying agitator 3, preferably an impeller agitator, is mounted maximally at a distance of D/2 from the bottom of the agitator vessel.

The at least one baffle, such as baffles 2 is located in the top half of the agitator vessel.

Each baffle has the shape of an airfoil profile, i.e. the baffle is curved in the form of an Archimedean spiral or in the form of a part or parts of a circular arc.

Each baffle is mounted at a distance $R_1$ of $D/10 < R_1 < D/3$ from the interior wall of the vessel.

Each baffle has the height $h_s$ for which preferably the following relationship is true:

$$0.2 < h_s/D < 0.4.$$

The leading cross-section or efflux cross-section of each baffle is preferably rectangular; i.e. the area exposed to oncoming flow or in the direction of rotation of the liquid is rectangular.

Furthermore, the invention has as its object, a process for the thorough mixing of liquids with the aid of the above-described agitator vessel.

The following advantages are attained by the process of the present invention:

1. The entire amount of liquid is homogeneously intermixed.
2. A high axial circulation is obtained.
3. The shape of the baffles 2 ensures an astonishingly low power consumption.
4. The liquid is stirred without eddies.
5. The baffles can be adjusted in their height as well as in their angle with respect to the liquid to be agitated, and thus can be adapted also to very differing agitation problems.

6. When using a radially conveying agitator with bottom drive means, a very short agitator shaft is adequate.

As shown in FIGS. 1 and 2, the agitator vessel utilized according to this invention involves an upright agitator vessel 1 of cylindrical shape with a customarily vertical axis. The proportion or ratio between the height H of the vessel and the diameter D of the vessel is in most instances larger than 1, being in particular between 1.5 and 2.5. The agitator vessel 1 customarily exhibits a bottom having the configuration of a basket, a sphere, or dish. The latter is preferred. The total volume of the agitator vessel is uncritical.

The agitator vessel is usually equipped with a one-stage agitator 3 in the proximity of the bottom. Thus, there is no need for providing the vessel with a multi-stage agitator or with several agitators, as is frequently done in difficult cases with other stirrer types. The shape of the agitator 3 corresponds to that of an impeller agitator. The agitator diameter d is 0.5 D to 0.7 D; the blade height is 0.2 d. The angle with respect to the horizontal is usually adapted to the bottom configuration of the agitator vessel.

The agitator vessel 1 contains at least one rotatably arranged baffle or flow diverter 2; preferably, two are provided. These are suitably mounted so that the baffles dip into the top third of the liquid standing in the vessel, and the spacing of their fulcrum from the vessel wall amounts to between 0.1 D and 0.2 D. The angle of attack alpha is preferably between 0° and 60° (see FIG. 2).

The cross-sectional area of the baffle 2 is similar to an airfoil profile, the center line of which is preferably fashioned as a section of Archimedean spiral. For reasons of manufacturing technique, this is in many cases replaced by a circular arc. The radius of this circle lies between about 0.15 D and 0.33 D. In the simplest case, the baffle 2 can have the form of a plate, the cross section of which corresponds to the above-described center line. The height of the baffle 2 ranges ordinarily between 0.2 D and 0.5 D.

The agitator vessel 1 is used with special advantage in case dispersions must be maintained made up of two different mutually immiscible liquids having different densities.

Such a problem arises, for example, in the manufacture of polystyrene foam. An aqueous suspension containing styrene polymers and unreacted, monomeric styrene is combined with a blowing agent, e.g. pentane. It can be seen from U.S. Pat. No. 4,497,911 that the product properties of foamed polystyrene are substantially influenced by the agitating procedure. The thorough axial intermixing here has an especially positive effect.

Another area of application concern the polymerization of suspension PVC. In this process, froth formation occurs on the surface of the reaction batch under certain circumstances during polymerization. In reactors equipped with reflux condensers, this froth also settles in the bottom part of the condenser. As a consequence, obstructions arise, damage to the material is incurred, and the condenser fails. When using the above-described agitating system in this critical phase of the polymerization, the formation of froth can in many cases be avoided entirely.

The experiments set forth below relate to the process described in U.S. Pat. No. 4,497,911 for the production of finely divided, expandable styrene polymers. As heretofore noted, FIG. 1 shows an agitator vessel of this invention for carrying out the experiments. The direction of rotation of the agitator is denoted by 4.

COMPARATIVE EXAMPLE A

Example 8 of U.S. Pat. No. 4,497,911 demonstrates that it is possible, using the agitator vessel illustrated in FIG. 1 of this reference and comprising the DAT agitator system, to effect funnel-free agitation and to obtain good product properties. However, in this case, it is necessary to utilize an agitator vessel having two mutually independent agitators. This is comparatively expensive.

COMPARATIVE EXAMPLE B

Example 11 of U.S. Pat. No. 4,497,911 shows that, using the agitator vessel illustrated in FIG. 1 of this reference and comprising a Pfaudler system, products are obtained having unsatisfactory quality in case of low filling levels.

COMPARATIVE EXAMPLE C

Example 1 of U.S. Pat. No. 4,497,911 demonstrates that, with the use of the agitator vessel having a Pfaudler agitating system illustrated in FIG. 2 of this reference, with a filling level of 90%, products evolve which likewise are of unsatisfactory quality.

EXAMPLE 1

The agitator vessel according to this invention is utilized in place of the agitator vessel with Pfaudler agitating system disclosed in Example 1 of U.S. Pat. No. 4,497,911. An impeller agitator is involved here which is completely immersed in the liquid. Two baffles having a circular airfoil profile are employed. The following dimensions were determined:

$V = 40$ l
$D = 350$ mm
$d = 250$ mm
$n = 120\ \text{min}^{-1}$
$R_1 = 50$ mm
alpha $= 20°$ Even with a filling level of 90% and correspondingly high numbers of revolutions of the agitator, no funnel arises during agitation. The product quality corresponds to that of Example 1(see Table 1 of U.S. Pat. No. 4,497,911).

What is claimed is:

1. An agitator vessel comprising a vessel with a diameter D equipped with at least one adjustable baffle and a radially conveying agitator mounted at a spacing of maximally D/2 from the bottom of the agitator vessel, characterized in that the at least one baffle (1) is located in the top half of the agitator vessel;

(2) is mounted at a spacing $R_1$ from the agitator vessel wall wherein the relationship applies $$D/10 < R_1 < D/3$$

(3) has a height $h_s$, and (4) exhibits or exhibit the shape of an airfoil profile, i.e. it is curved in the form of an Archimedean spiral or in the form of part of a circular arc.

2. An agitator vessel according to claim 1, characterized in that the agitator is an impeller agitator with a bottom drive.

3. An agitator vessel according to claim 1, characterized in that the vessel is equipped with 1 to 4 baffles.

4. An agitator vessel according to claim 1, characterized in that the following relationship applies with respect to the height of the at least one baffle, $h_s$:

$$0.2 < h_s/D < 0.4$$

5. An agitator vessel according to claim 1, characterized in that the leading cross-section of the at least one baffle in the direction of rotation is rectangular.

6. A process for thorough mixing of liquids, the process comprising the steps of:

providing an agitator vessel with a diameter D and a radially conveying agitator mounted at a maximum spacing of D/2 from a bottom of the agitator vessel;

mounting at least one air foil profiled adjustable baffle of a predetermined height in a top half of the agitator vessel at a spacing $R_1$ from a wall of the agitator vessel in accordance with the relationship $D/10 < R_1 < D/3$; and filling the agitator vessel to a filling level $H_L$, wherein a ratio between filling level $H_L$ and diameter D is large than 1.

7. A process according to claim 6, wherein the agitator is a bottom driven impeller agitator.

8. A process according to claim 6, wherein the one to four baffles are mounted at the agitator vessel.

9. A process according to claim 6, wherein the predetermined height $h_s$ of the at least one adjustable baffle and the diameter D of the agitator vessel have the following relationship:

$$0.2 < h_s/D < 0.4 .$$

10. A process according to claim 6, wherein the at least one adjustable baffle has a rectangular leading cross section, as viewed in a direction of rotation of the conveying agitator.

* * * * *